US007036395B2

(12) United States Patent
Sapienza

(10) Patent No.: US 7,036,395 B2
(45) Date of Patent: May 2, 2006

(54) ROOFING TOOL

(76) Inventor: Michael Sapienza, 5628 White Oak Way, North Ridgeville, OH (US) 44039

( * ) Notice: Subject to any disclaimer, the term of this patent is extended or adjusted under 35 U.S.C. 154(b) by 0 days.

(21) Appl. No.: 10/818,104

(22) Filed: Apr. 5, 2004

(65) Prior Publication Data

US 2004/0194583 A1 Oct. 7, 2004

Related U.S. Application Data

(60) Provisional application No. 60/460,893, filed on Apr. 7, 2003.

(51) Int. Cl.
*E04D 15/02* (2006.01)

(52) U.S. Cl. ..... 81/45; 30/169

(58) Field of Classification Search ..... 81/45; 30/169, 170

See application file for complete search history.

(56) References Cited

U.S. PATENT DOCUMENTS 2,714,907 A * 8/1955 Peck ..... 81/45
4,663,995 A * 5/1987 Amundson et al. ..... 81/45
4,699,430 A * 10/1987 Nichols ..... 299/37.1
4,709,479 A * 12/1987 Lavelette ..... 30/170
4,763,547 A * 8/1988 Dike, Jr. ..... 81/45
4,880,491 A * 11/1989 Jacobs et al. ..... 156/584
5,001,946 A * 3/1991 Shirlin et al. ..... 81/45
5,076,119 A * 12/1991 Wenz ..... 81/45
5,218,766 A * 6/1993 Himebaugh ..... 30/170
5,819,603 A * 10/1998 Murray ..... 81/45
5,921,155 A * 7/1999 Faller et al. ..... 81/45
5,988,021 A * 11/1999 Nicolosi et al. ..... 81/45
6,095,015 A * 8/2000 Phelan ..... 81/45
6,116,117 A * 9/2000 Nicolosi et al. ..... 81/45
6,453,774 B1 9/2002 Khachatoorian
6,711,971 B1 * 3/2004 Morin ..... 81/45

* cited by examiner

*Primary Examiner*—David B. Thomas
(74) *Attorney, Agent, or Firm*—Fay, Sharpe, Fagan, Minnich & McKee, LLP

(57) ABSTRACT

A roof tool having a movable blade for removing roofing materials from a roof includes a carriage and a handle assembly pivotally mounted at a first end to the carriage. A blade is mounted adjacent the first end of the handle assembly for movement with the handle assembly when the handle assembly is pivotally moved relative to the carriage. Movement of a second end of the handle assembly causes leveraged movement of the blade relative to the carriage.

25 Claims, 3 Drawing Sheets

ROOFING TOOL

This application claims the benefit of and hereby expressly incorporates herein by reference U.S. Provisional Patent Application No. 60/460,893, filed Apr. 7, 2003.

BACKGROUND OF THE INVENTION

1. Field of the Invention

The present invention relates to prying tools and, more particularly, to a roofing tool that eases the labor-intensive process of removing roofing materials, such as, for example, shingles, built-up roofs, single ply roofs, etc., from an underlying surface. The present invention finds particular application as a bladed roof tool that utilizes a leverage action to "rip" roofing materials off a roof. However, it is to be appreciated that the invention may relate to other similar environments and applications.

2. Description of the Art

Proper building maintenance periodically requires the roof of a building to be repaired and/or replaced. With a shingle roof, it is often desirable to remove the old shingles prior to installing new shingles. Although new shingle roofs can sometimes be installed directly on top of old shingle roofs, such layering is sometimes impractical, such as when the old roof is concealing damage to a roof sub-structure that needs repaired. Moreover, adding new shingles over old shingles can be in violation of building codes as many building codes restrict or limit the number of shingle layers allowed on a particular roof. Thus, not only is it often desirable, but it is often necessary to remove old shingles prior to installing a new shingle roof. Similarly, other roofing materials, such as built-up roofs and single ply roofs, are often desirably removed when repairing or replacing a roof.

When shingles or other roofing materials of a roof are replaced, the old roofing materials are typically discarded as they are not usually reusable. Roof material removal and, particularly, shingle removal are often labor intensive processes and, since the removed materials are merely discarded, it is desirable to remove the old materials quickly, conveniently and in the least expensive manner. Heretofore, several roof material and shingle-removing tools have been devised to assist in the removal of old roofing materials and shingles but such removal remains a labor intensive task. Thus, roof material and shingle removal tools that can further reduce the labor and time involved in removing old roofing materials are deemed desirable.

SUMMARY OF THE INVENTION

The present invention provides a roof tool that overcomes the foregoing difficulties and others and provides the aforementioned and other advantageous features. In accordance with one aspect of the present invention, a roof tool having a movable blade is provided for removing roofing materials from a roof. More particularly, in accordance with this aspect of the invention, the roof tool includes a carriage and a handle assembly pivotally mounted at a first end to the carriage. A blade is mounted adjacent the first end of the handle assembly for movement with the handle assembly when the handle assembly is pivotally moved relative to the carriage. Movement of a second end of the handle assembly causes leveraged movement of the blade relative to the carriage.

In accordance with another aspect of the present invention, a roof tool having a pivotally movable blade and an elongated handle assembly that provides leverage in moving the blade is provided for removing shingles or other debris from a roof. More particularly, in accordance with this aspect of the invention, the roof tool includes a frame and a blade pivotally mounted to the frame adjacent a forward end of the frame. An elongated handle assembly extends from the blade to provide leverage when pivotally moving the blade relative to the frame.

In accordance with yet another aspect of the present invention, a prying tool having a moveable blade is provided for removing materials from an underlying surface. More particularly, in accordance with this aspect of the invention, the prying tool includes a carriage and a handle assembly pivotally mounted at a first end to the carriage. A blade is mounted adjacent the first end of the handle assembly for movement with the handle assembly when the handle assembly is pivotally moved relative to the carriage. Movement of a second end of the handle assembly causes leveraged movement of the blade relative to the carriage.

BRIEF DESCRIPTION OF THE DRAWINGS

The invention may take physical form in various components and arrangements of components. The drawings are only for purposes of illustrating one or more preferred embodiments of the invention and are not to be construed as limiting the invention.

DETAILED DESCRIPTION OF THE PREFERRED EMBODIMENTS

Figure 1:
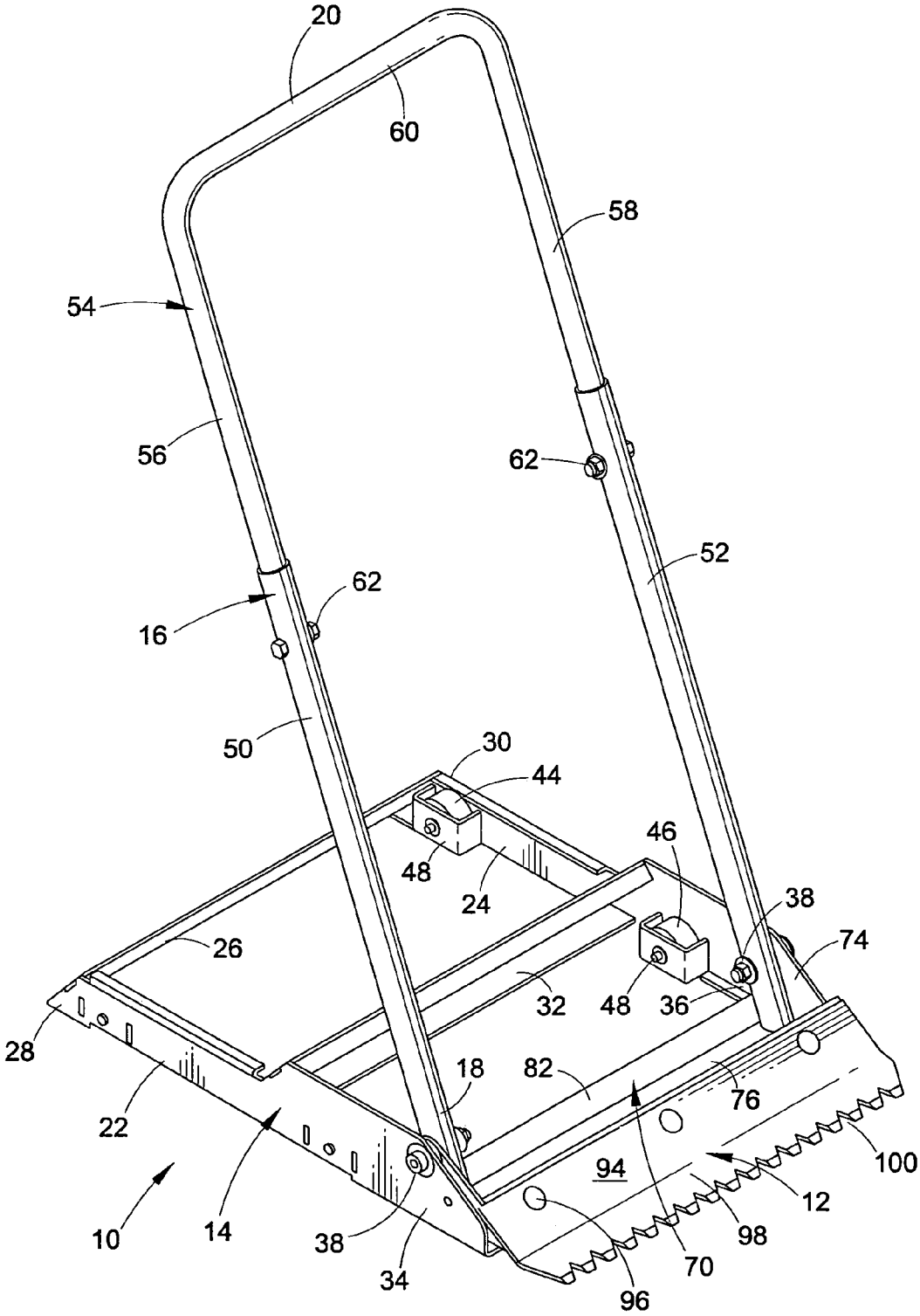
FIG. 1 is a perspective view of a roof tool in accordance with one preferred embodiment of the present invention.
Figure 2:
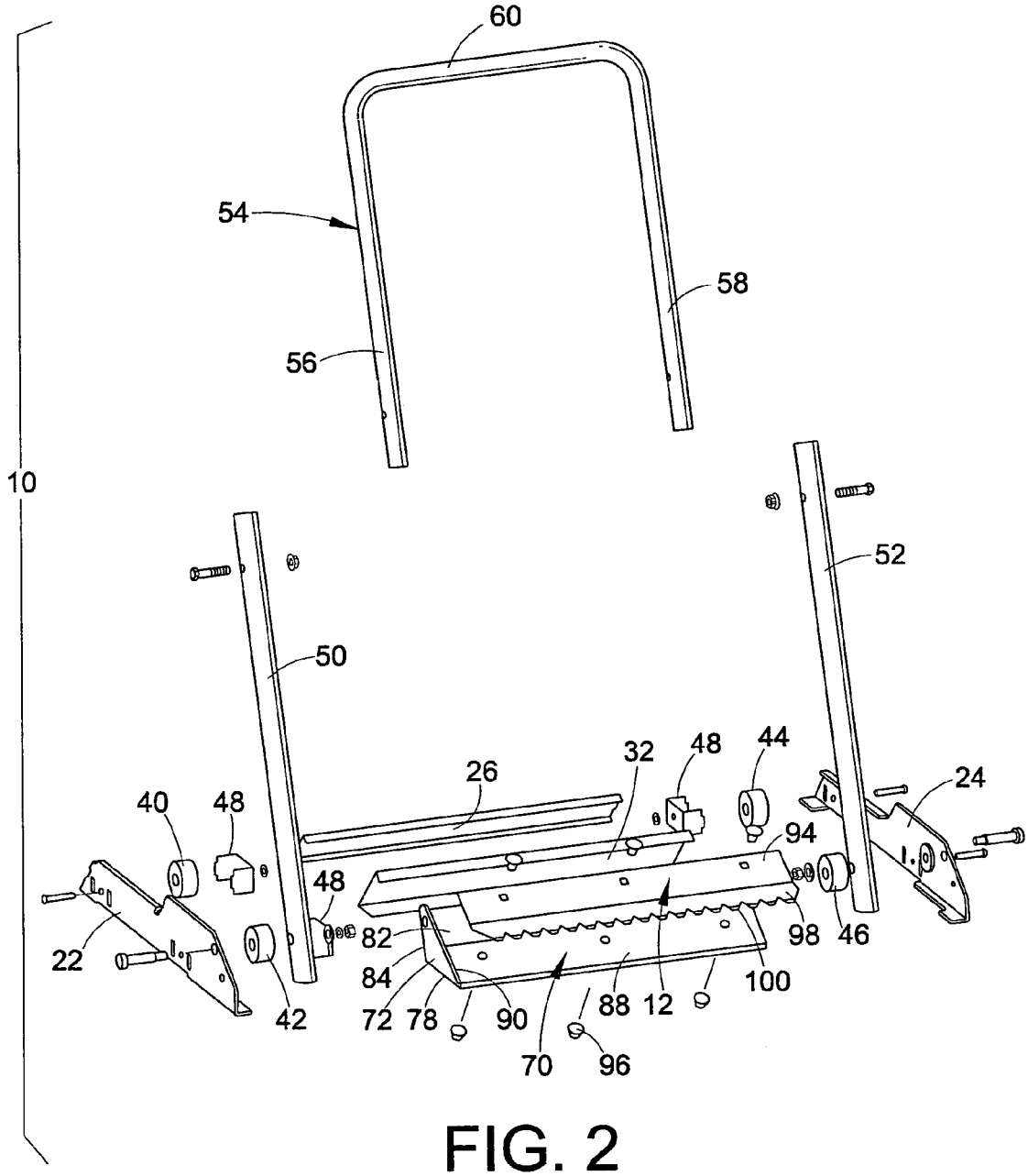
FIG. 2 is an exploded perspective view of the roof tool of FIG. 1.

Referring now to the drawings wherein the showings are for purposes of illustrating one or more preferred embodiments of the invention only and not for purposes of limiting the same, FIGS. 1 and 2 show a roof tool 10 having a pivotally movable blade 12 for removing shingles from a roof in accordance with one preferred embodiment of the present invention. The roof tool 10 includes a low profile frame or carriage 14 and an elongated handle assembly 16 which is pivotally mounted to the carriage 14. More specifically, the handle assembly 16 includes a first or downward end 18 that is pivotally mounted to the carriage 14 and a second or upward end 20 that is spaced apart from the first end and upwards relative to the carriage 14.

The blade 12 is mounted to or adjacent the first end 18 of the handle assembly 16 for movement with the handle assembly 16 when the handle assembly is pivotally moved relative to the carriage 14. Thus, through the handle assembly 16, the blade 12 is pivotally mounted to the carriage 14 adjacent a forward end thereof. As will be described in more detail below, movement of the second end 20 of the handle assembly 16 provides or causes leveraged movement of the blade 12 relative to the carriage 14. The carriage 14 includes a first side member 22 and a second side member 24 spaced apart from the first side member 22. The carriage 14 further includes a first or rear cross beam 26 extending between the first and second side members 22,24 at or adjacent rear ends 28,30 of the side members 22,24 and a second or middle cross beam 32 also extending between the first and second side members 22,24.

The handle assembly 16 pivotally attaches to the first and second side members 22,24 adjacent or at front ends 34,36 thereof so that the blade 12 is disposed between the side members 22,24 adjacent their front ends 34,36. Specifically, pivot assemblies 38 pivotally connect the handle assembly 16 to the side members 22,24. Pivot assemblies are generally known and any known pivot assembly can be substituted for the pivot assemblies 38 shown herein. Optionally, one or both of the cross beams 26,32 include a push pad (not shown) for receiving an applied force to push the blade 12. More specifically, the push pad is positioned so that a user of the roof tool 10 could use a foot to apply additional forward force to the carriage 14 to move the blade 12 under or forward through roof debris such as roof shingles being removed from a roof. Alternatively, as shown, the carriage 14 can be provided without a designated push pad and a user can use one or both of the cross beams 26,32 for directly receiving an applied force, such as that applied by the foot of the user.

The carriage 14 has a plurality of rollers 40,42,44,46 each rotatably mounted to the carriage 14 for assisting in moving the carriage along an underlying surface, such as a roof. In the illustrated embodiment, two rollers 40,42 are attached to an inner side of the first side member 22 and two rollers 44,46 are attached to an inner side of the second side member 24. The rollers 40,44 are positioned adjacent respective rear ends 28,30 of the side members 22,24 just inside the rear cross beam 26. The rollers 42,46 are positioned between the middle cross beam 32 and the blade 12. Guards 48 are provided around each of the rollers 40–46 to prevent debris removed by the blade 12 from interfering with rotation of the rollers. In the illustrated embodiment, the guards 48 are U-shaped members that extend around the front, rear and exposed inner sides of the rollers.

The handle assembly 16 includes a pair of spaced apart elongated members 50,52 that extend upward from the blade 12. A U-shaped handle member 54 connects the elongated members 50,52 adjacent the second end 20 of the handle assembly 16. More specifically, the U-shaped handle member 54 includes a first leg 56 that is received in a first 50 of the elongated members and a second leg 58 that is received in a second 52 of the elongated members. The U-shaped handle member 54 further includes a connecting portion 60 connected to the first and second legs 56,58.

The first and second legs 56,58 are axially movable relative to the elongated members 50,52 for adjusting a longitudinal length of the handle assembly 16. More specifically, the legs 56,58 are respectively received within the elongated members 50,52 and a slidably movable in relation thereto. Locking bolt assemblies 62 are provided for locking the position of the legs 56,58 relative to the elongated member 50,52 thereby locking the longitudinal length of the handle assembly 16.

A bucket member 70 is provided at or adjacent the downward end 18 of the handle assembly 16. The bucket member 70 extends between the first and second elongated members 50,52 and has the blade 12 attached thereto. More specifically, the blade 12 is mounted to, and forward of, the bucket member 70 so that debris removed by the blade 12 is caught by the bucket member 70. The bucket member includes a first side piece 72 connected to the first elongated member 50 and a second side piece 74 connected to the second elongated member 52. A base wall 76 extends between the first and second side pieces 72,74 adjacent bottom edges 78 thereof. Additionally, a rear wall 82 extends between the first and second side pieces 72,74 adjacent rear edges 84 thereof and a blade mounting wall 88 extends between the first and second side pieces 72,74 adjacent forward portions of connecting edges 90 of the first and second side pieces 72,74.

The blade 12 is mounted to the blade mounting wall 88 for removing debris and depositing debris within a partial enclosure formed by the pieces 72,74 and walls 76,82,88. The blade 12 includes a mounting portion 94 that abuts the blade mounting wall 88. Rivets 96, or any other suitable connecting means, secure or connect the blade 12 to the mounting wall 88. As shown, the mounting wall 88 and the mounting portion 94 of the blade 12 are generally at an angle relative to the underlying surface upon which the carriage 14 is resting when the handle assembly 16 is in a first; upright position (position shown in FIG. 1). The blade 12 includes a serrated portion 98 having a serrated edge 100. The serrated portion 98 is oriented relative to the carriage 14 to be generally parallel to an underlying surface upon which the carriage 14 is resting when the handle assembly 16 is in the first position.

More specifically, the blade 12 is oriented relative to the handle assembly 16 so that the serrated edge 100 is generally parallel to a bottom plane of the carriage 12 when the handle assembly 16 is in the first position. The bottom plane being the plane generally defined by an underside of the carriage 12. The serrated edge 100 is lifted upward from the underlying surface when the handle assembly 16 is moved toward a second position. The handle assembly 16 is in the second position when it is fully pivoted relative to the carriage 14. Thus, movement of the handle assembly 16 from the first position toward the second position causes the blade 12 to pivot and/or lift upwards from the underlying surface.

In the first position, the handle assembly 16 and, more particularly, the elongated members 50,52 are at approximately fifty-five degrees (55°) to eighty-five (85°) relative to the carriage 14 and the serrated portion 98 is at approximately zero degrees (0°) relative to the carriage 14, i.e., the serrated portion 98 is parallel to the carriage 14 and the underlying surface. In the second position (not shown), the handle assembly 16 and the elongated members 50,52 are at approximately zero degrees (0°) relative to the carriage 14 and the serrated portion 98 is at approximately fifty-five degrees (55°) to eighty-five (85°) relative to the carriage 14 and the underlying surface. Thus, the elongated members 50,52 extend upwards from the blade 12 to provide leverage when pivotally moving the blade 12 relative to the carriage 14.

In operation, the roof tool 10 is placed on a support or underlying surface of which it is desirable to remove shingles or some other similar layer attached thereto (including other roofing materials, built-up roofs, single ply roofs, etc.). With the handle assembly 16 in the first position (the blade being level with the underlying surface), the carriage 14 is moved or thrust forward so the blade 12 can cut or rip into the roof materials or shingles to be removed. Forward motion of the carriage 14 is assisted by the rollers 40–46 and, when employed, can be further assisted by application of a force upon on one of the push pads of the tool 10. If no push pads are used, additional force can be applied to one or both of the cross beams 26,32. For example, a user could employ a foot to apply additional forward thrust to the carriage 14. When the blade 12 is sufficiently beneath at least some of the roofing materials or shingles to be removed, the handle assembly 16 is moved toward the second position.

As already discussed, the elongated members 50,52 of the handle assembly 16 extending upward from the blade 12 provide leverage to the blade 12 when the handle assembly 16 is pivotally moved from the first position toward the second position. During this leveraged movement, the blade 12 pivots upward with the handle assembly 16 and further rips the roofing materials and/or shingles from the underlying structure. This action of forcing or wedging the blade 12 into the roofing materials/shingles combined with leveraged upward movement of the blade 12 can be repeated across the underlying structure to remove additional roofing materials and/or shingles as desired.

Figure 3:
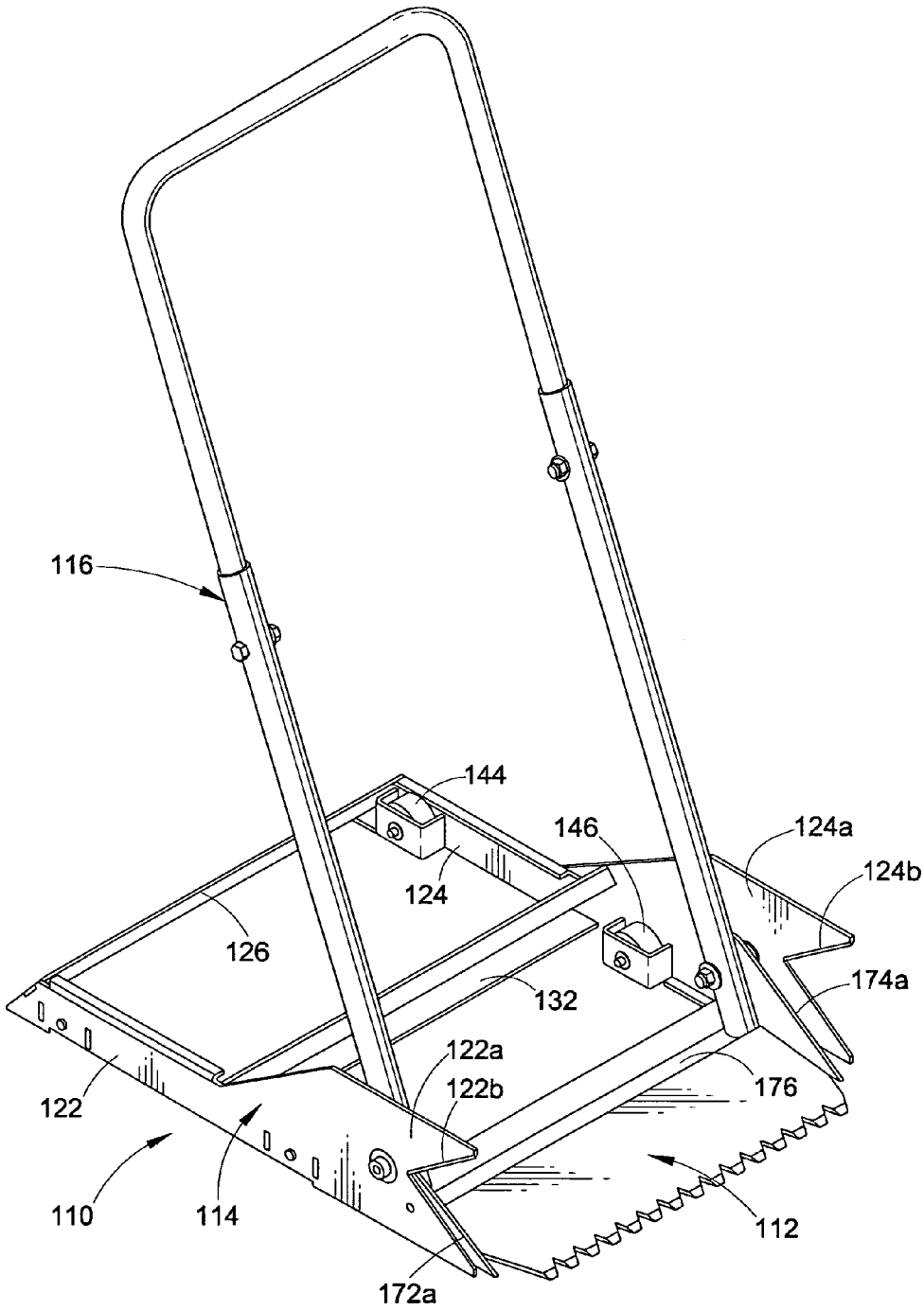
FIG. 3 is a perspective view of a roof tool in accordance with another preferred embodiment of the present invention.

With reference to FIG. 3, a roof tool 110 is shown having a pivotally movable blade 112 for removing shingles from a roof in accordance with another preferred embodiment of the present invention. As will be described in more detail below, the roof tool 110 includes opposed shear edges flanking each end of a blade 112 that function to provide a scissor effect when the blade 112 is moved relative to a carriage 114 by a handle assembly 116. The scissor effect enables the roof tool 110 to cut shingles that have been uplifted by the moving blade 112 away from other shingles still attached to a roof or other underlying surface. In most other respects, the roof tool 110 is like the roof tool 10. For example, the blade 112 is attached to the handle assembly 116 for pivotal movement relative to the carriage 114 when the handle assembly 116 is moved from a first position (shown in FIG. 3) to a second position.

Shear edges are provided on side members 122,124 and on side pieces 172,174. More specifically, the side members 122,124 include upper portions 122*a*,124*a* having an upper shear edge 122*b*,124*b*. The shear edge 122*b* on the side member 122 angles upwardly in a forward direction (direction of blade 112 on carriage 114). Likewise, the shear edge 124*b* on the side member 124 angles upwardly in the forward direction.

Connecting edges 172*a*,174*a* of the side pieces 172,174 are shear edges that flank the blade 112. The edges 172*a*, 174*a* angle downwardly in the forward direction of the roof tool 110. An assembly 170 is like the assembly 70 but does not include a blade mounting wall. Rather, the blade 112 is attached directly to base wall 176 or, alternatively, formed integrally therewith.

In operation, the roof tool 110 functions much like the tool 10 with the additional scissor effect achieved by the shear edges 122*b*,124*b*,172*a*,174*a*. Thus, the roof tool 110 is placed on a support or underlying surface of which it is desirable to remove shingles or some other similar layer attached thereto. With the handle assembly 116 in a first position (similar to the first position of the blade assembly 16) and the blade 112 generally parallel with a plane defined by an underside of the carriage 114, the carriage is moved or thrust forward so the blade can cut or rip into the shingles.

At the same time, the shear edges 122*b*,124*b*,172*a*,174*a* can also cut or rip into the shingles. Like the tool 10, push pads could optionally be added to the roof tool 110. Without push pads, a user can apply a force to cross members 126,132 to assist in moving the blade 112 into shingles. Rollers (only 144 and 146 shown) also assist in moving the carriage 114 forward. When the blade 112 is beneath a desired amount of shingles, the handle assembly 116 can be moved back and forth as the carriage moves forward to, in effect, scissor the shingles between the sets of shears 122*b*, 172*a* and 124*b*,174*a* to cut shingles.

Like the tool 10, elongated members 150,152 of the handle assembly 116, which extend upward from the blade 112, provide leverage to the blade 112 when the handle assembly 116 is pivotally moved from the first position toward the second position. The elongated members 150,152 also provide leveraged movement of the lower shear edges 172*a*,174*b* toward and relative to the upper shear edge 122*b*,124*b*. During the leveraged movement of the handle assembly 116, the blade 112 pivots upward with the handle assembly 116 and further rips roofing materials or shingles to be removed from the underlying structure. At the same time, the shear edges cut the ripped roofing materials or shingles from those still attached to the underlying structure. These actions can be repeated across the underlying structure to remove additional roofing materials and/or shingles as desired.

Although the tools 10,110 are described for removing roofing materials from an underlying structure, it should be appreciated by those skilled in the art that the tools 10,110 are readily employed in other similar applications where removal of materials from an underlying surface is desirable. For example, the tools 10,110 could be used for removing flooring from an underlying floor structure. The scope of the present invention should be considered to encompass this and other similar uses and is not to be limited to roofing applications.

The invention has been described with reference to one or more preferred embodiments. Obviously, modifications and alterations will occur to others upon reading and understanding the preceding detailed description. It is intended that the invention be construed as including all such modifications and alterations insofar as they are within the scope of the appended claims or the equivalents thereof.

The invention claimed is:

1. A roof tool having a movable blade for removing roofing materials from a roof, comprising:

a carriage having a plurality of rollers rotatably mounted thereto for assisting in moving said carriage along an underlying surface;

a handle pivotally mounted to said carriage; and a blade mounted adjacent a first end of said handle assembly for movement with said handle assembly when said handle assembly is pivotally moved relative to said carriage and for causing leveraged movement of said blade relative to said carriage which is able to occur simultaneously with movement of said carriage along said roof.

2. The roof tool of claim 1 wherein each of said plurality of rollers includes guards provided therearound to prevent debris from interfering with rotation of each of said plurality of rollers.

3. The roof tool of claim 1 wherein said handle assembly includes a pair of spaced apart elongated members extending upward from said blade and a U-shaped handle member provided adjacent said second end.

4. The roof tool of claim 3 wherein said U-shaped handle member includes a first leg received in a first of said elongated members and a second leg received in a second of said elongated members, said U-shaped handle member further includes a connecting portion connected said first leg to said second leg, said first and second legs axially movable relative to said elongated members for adjusting a longitudinal length of said handle assembly.

5. The roof tool of claim 3 wherein said handle assembly further includes a bucket member extending between said first and second elongated members adjacent said first end of said handle assembly, said blade mounted forward of said bucket member so that at least some debris removed by said blade is caught by said bucket member.

6. The roof tool of claim 8 wherein said bucket member includes:

a first side piece connected to said first elongated member;

a second side piece connected to said second elongated member;

a base wall extending between said first and second side pieces adjacent bottom edges of said first and second side pieces;

a rear wall extending between said first and second side pieces adjacent rear edges of said first and second side pieces; and a blade mounting wall extending between said first and second side pieces adjacent forward portions of connecting edges of said first and second side pieces, said blade mounted to said blade mounting wall for removing debris and depositing debris within a partial enclosure formed by said first and second side pieces and said base, rear and blade mounting walls.

7. The roof tool of claim 1 wherein said blade includes a serrated edge.

8. The roof tool of claim 7 wherein said blade is oriented relative to said handle assembly so that said serrated edge is generally parallel to a bottom plane of said carriage when said handle assembly is in a first position and said serrated edge is lifted upward when said handle assembly is moved from said first position to a second position.

9. The roof tool of claim 1 wherein said handle assembly is approximately fifty-five degrees (55°) to eighty-five degrees (85°) relative to said carriage in said first position.

10. The roof tool of claim 1 wherein said carriage includes:

first and second spaced apart side members each having a shear edge;

a cross beam extending between said first and second spaced apart side members; and said handle assembly pivotally attached to said first and second spaced apart side members adjacent front ends thereof, said blade positioned between said first and second spaced apart side members adjacent said front ends.

11. The roof tool of claim 10 wherein said handle assembly includes a bucket member to which said blade is attached, said bucket member including sides each having a lower shear edge that, upon movement of said blade, respectively cooperate with said shear edges of said first and second spaced apart side members for providing a scissor effect to cut shingles.

12. The roof tool of claim 11 wherein said shear edge on each of said first and second spaced apart side members angles upwardly in a forward direction of said carriage and said lower shear edges angle downwardly in said forward direction of said carriage.

13. The roof tool of claim 1 wherein the carriage includes:

a first side member;

a second side member spaced apart from said first side member; and at least one cross beam extending between said first side member and said second side member, said at least one cross beam including a push pad portion for receiving an applied force to push said blade under roof shingles.

14. A roof tool having a movable blade for removing roofing materials from a roof, comprising:

a carriage including:

a first side member, a second side member spaced apart from said first side member, and at least one cross beam extending between said first side member and said second side member said at least one cross beam including a push pad portion for receiving an applied force to push the blade under roof shingles;

a handle assembly pivotally mounted at a first end to said carriage; and a blade mounted adjacent said first end of said handle assembly for movement with said handle assembly when said handle assembly is pivotally moved relative to said carriage, movement of a second end of said handle assembly causing leveraged movement of said blade relative to said carriage, said handle assembly pivotally attached to each of said first and second side members adjacent front ends thereof so that said blade is disposed between said first and second side members adjacent said front ends.

15. The roof tool of claim 14 wherein said carriage has a plurality of rollers rotatably mounted thereto for assisting and moving said carriage along an underlying surface.

16. A roof tool having a pivotally movable blade and an elongated handle assembly that provides leverage in moving said blade for removing shingles or other debris from a roof, comprising:

a transversely movable frame;

a blade having a serrated edge pivotally mounted to said frame adjacent a forward end of said frame; and an elongated handle assembly extending from said blade to provide leverage when pivotally moving said blade relative to said frame, said blade movable together with said frame to remove shingles or other debris.

17. The roof tool of claim 16 further including:

rollers rotatably mounted to said frame for more easily moving said frame on an underlying surface.

18. The roof tool of claim 16 wherein said frame is a low profile frame and said handle assembly extends upward from said low profile frame.

19. The roof tool of claim 16 wherein said carriage includes:

a first side member;

a second side member spaced apart from said first side member; and at least one cross beam extending between said first side member and said second side member, said at least one cross beam including a push pad portion for receiving an applied force to push said blade under roof shingles.

20. The roof tool of claim 16 wherein said carriage includes:

first and second spaced apart side members each having a shear edge;

a cross beam extending between said first and second spaced apart side member; and said handle assembly pivotally attached to said first and second spaced apart side members adjacent front ends thereof, said blade position between said first and second spaced apart side members adjacent said front ends.

21. A prying tool having a movable blade for removing materials from an underlying surface, comprising:

a carriage movable along an underlying surface, said carriage including first and second spaced apart side members each having a shear edge, a cross beam extends between said spaced apart side members;

a handle assembly pivotally mounted to said carriage; and a blade mounted adjacent said first end of said handle assembly for movement with said handle assembly when said handle assembly is pivotally moved relative to said carriage, movement of a second end of said handle assembly causing leveraged movement of said blade relative to said carriage, said carriage movable simultaneously with movement of said handle assembly.

22. The prying tool of claim 21 wherein said carriage has a plurality of rollers rotatably mounted thereto.

23. The prying tool of claim 21 wherein said blade includes a serrated edge.

24. The prying tool of claim 21 wherein said carriage includes:

a first side member;

a second side member spaced apart from said first side member; and at least one cross beam extending between said first side member and said second side member, said at least one cross beam including a push pad portion for receiving an applied force to push said blade under materials to be removed.

25. A method of removing materials from an underlying surface, comprising:

providing a prying tool including a carriage, a handle rotatably mounted to said carriage, and a blade mounted to said handle for movement therewith when said handle is moved relative to said carriage;

moving said handle rotatably relative to said carriage to remove materials from an underlying surface; and moving said carriage transversely on said underlying surface while moving said handle to further remove materials from the underlying surface, wherein movement of said carriage is effected by thrusting a foot against said carriage and movement of said handle is effected by pushing said handle toward said underlying surface.

* * * * *